United States Patent [19]

Pomeroy

[11] 4,114,792

[45] Sep. 19, 1978

[54] POWDER ACTUATED TOOL

[75] Inventor: Raymond V. Pomeroy, Portland, Oreg.

[73] Assignee: Omark Industries, Inc., Portland, Oreg.

[21] Appl. No.: 817,386

[22] Filed: Jul. 20, 1977

[51] Int. Cl.[2] ..... B25C 1/14

[52] U.S. Cl. ..... 227/8; 227/10

[58] Field of Search ..... 227/8, 9, 10, 11

[56] References Cited

U.S. PATENT DOCUMENTS

| | | | |
|---|---|---|---|
| 3,473,719 | 10/1969 | Jephson | 227/11 |
| 3,552,625 | 1/1971 | Udert | 227/10 |
| 3,554,425 | 1/1971 | Oesterle | 227/10 |
| 3,565,313 | 2/1971 | Seghezzi et al. | 227/10 |
| 3,632,032 | 1/1972 | Termet | 227/10 |
| 3,743,159 | 7/1973 | Schneider | 227/10 |

*Primary Examiner*—Granville Y. Custer, Jr.
*Attorney, Agent, or Firm*—Robert L. Harrington

[57] ABSTRACT

A tool for driving nails into hard surfaces wherein the driving power is provided by cartridges of explosive powder. The cartridges are contained in strips with a single strip containing a multiple of cartridges, in the order of ten. The improvement comprises the mechanism for feeding the strip of cartridges in increments automatically through the tool and for retaining the tool piston in its ready to be fired position. The feeding of the cartridges is accomplished by a camming finger connected to the barrel of the tool which progressively engages successive following lugs on the strip to move successive cartridges of the strip into place within the firing chamber as the tool is repeatedly engaged and disengaged with a work surface. A ring having a double loop configuration frictionally grips the piston to resist accidental displacement.

4 Claims, 7 Drawing Figures

POWDER ACTUATED TOOL

HISTORY OF INVENTION

This invention relates to a powder actuated tool and more specifically to a tool having automatic feed means for feeding a strip of cartridges automatically through the tool.

A powder actuated tool of the type herein contemplated is designed to accept a nail at the forward end of the barrel and a cartridge at the breech end of the barrel. The tool is pressed against a work surface to release a safety mechanism and then fired. The spent cartridge is removed, a new nail placed in the barrel, a new cartridge placed in the cartridge chamber and the process is repeated. It will be understood that loading the tool is time consuming and thus there have been numerous developments attempting to successfully automate tool loading, especially as concerns loading and ejecting cartridges. These patents include U.S. Pat. Nos. 3,552,625; 3,743,159; 3,554,425; and 3,565,313.

The present invention is directed to the improvement of a cartridge loading and cartridge ejection mechanism. Very briefly it comprises a strip of cartridges with cam following lugs provided along one edge, the strip is held in a magazine carried by the breech block, and a camming finger carried by the tool barrel indexes the strip through the magazine. When the tool barrel is forced against the work surface so as to move the barrel rearward in the tool housing for releasing the safety mechanism, this same movement causes the camming finger to engage successive cam following lugs on the edge of the strip to advance the strip of fasteners.

The invention and its advantages will be more clearly understood by reference to the following detailed description and drawings wherein.

Figures 3, 3A, 4, 5:
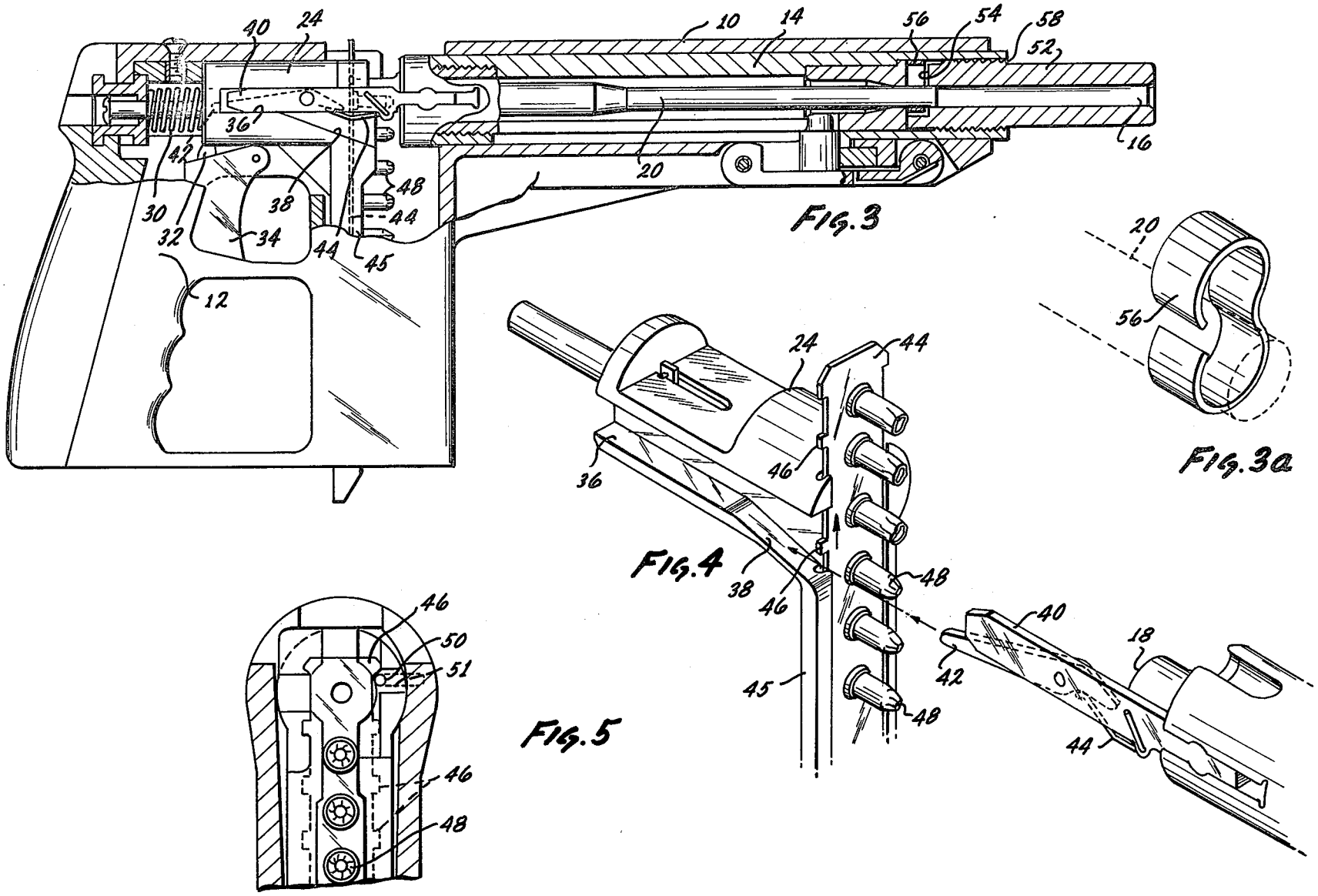
FIG. 3 is a view similar to FIG. 1 but illustrating the tool in position for firing and with the cartridge strip advanced from its position in FIG. 1.

FIG. 3*a* is a perspective view of the retaining clip utilized in the tool of FIG. 3;

FIG. 4 is a peripheral view showing only those parts of the tool and cartridge strip which produce the advancement of the strip; and FIG. 5 illustrates the mechanism that prevents return of the strip.

Figure 1:
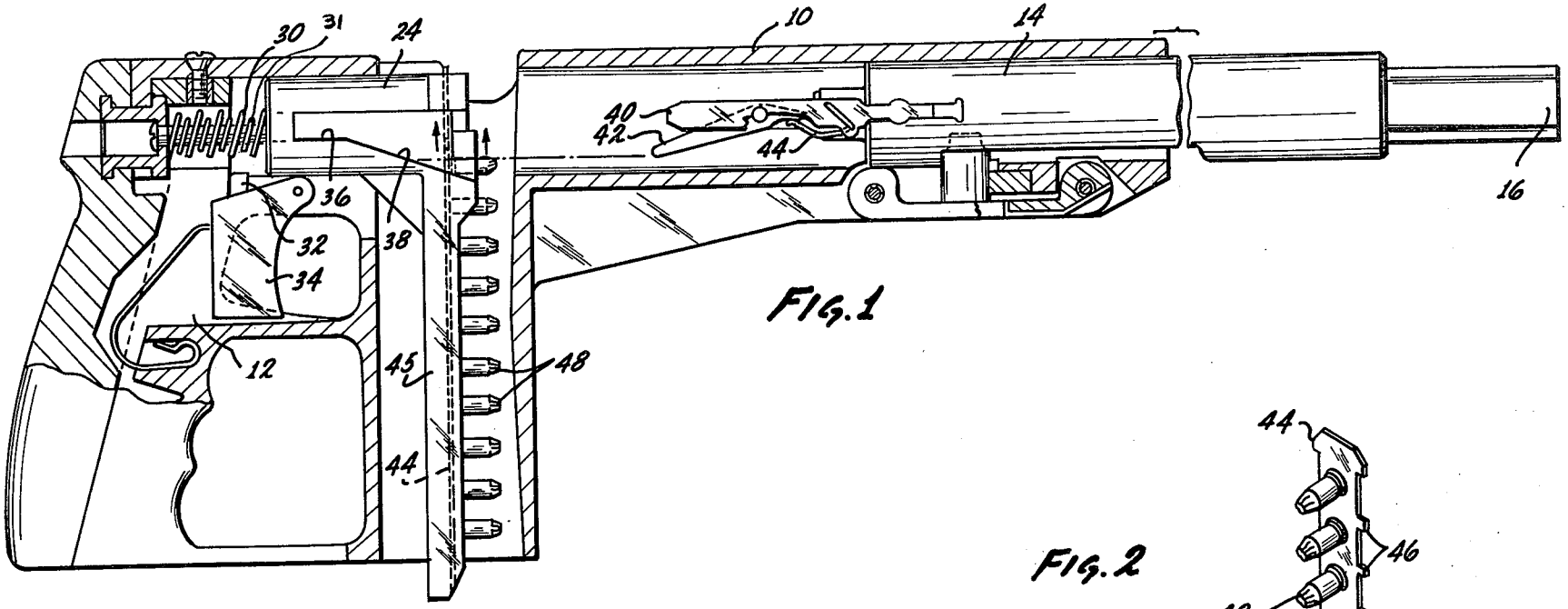
FIG. 1 is a side view in section of a tool in accordance with the present invention.
Figure 2:
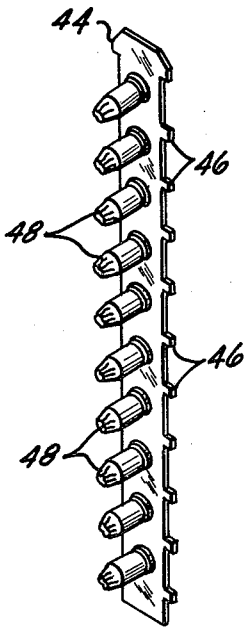
FIG. 2 is a perspective view of the cartridge strip used to load cartridges automatically in the tool, again, in accordance with the present invention.
Figure 6:
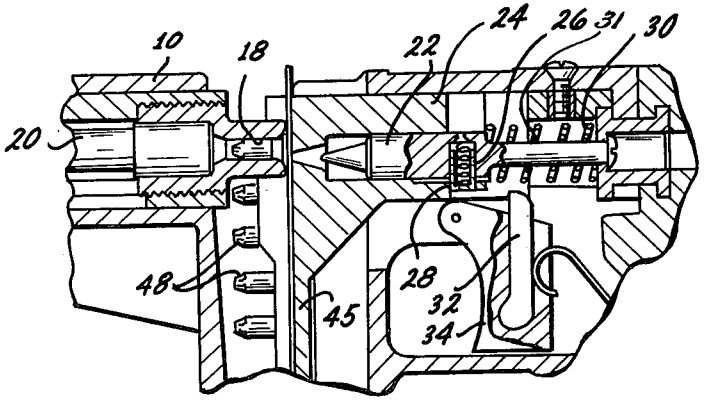

FIG. 6 is a partial view of the trigger mechanism and related parts of FIG. 1 but illustrated from the reverse side.

Referring to the drawings, the tool illustrated is designed to drive a nail into a hard surface, e.g., concrete. The main components which are conventional to such tools include a housing 10 integrally formed with a handle 12. A barrel 14 is slideable in the housing and is adapted to receive a nail at its forward end 16 and an explosive cartridge in its breech end 18. A piston 20 in the barrel is adapted to be driven by the cartridge into engagement with the nail.

Referring to FIG. 6, the cartridge is detonated by a firing pin 22 contained in breech block 24 which is slideably mounted in the housing. The firing pin is held against forward movement within the breech block by a sear 26 engaging a shoulder 28 of the breech block.

Firing is accomplished by abuting the exit end of the barrel against a hard surface and pushing against that surface to force the barrel rearward in the housing. The rearward end of the barrel engages the breech block and forces the breech block rearward against the bias of spring 30 and at the same time compresses spring 31 acting against the firing pin 22. When fully retracted the sear 26 is in line with a release finger 32 carried by a trigger 34. The operator pulls the trigger, the release finger 32 raises the sear to clear the shoulder 28 and spring 31 propels the firing pin at the cartridge.

As previously mentioned, the structure generally described above is typical of tools widely used in the industry and further explanation of that structure is unnecessary. The improvement of the present invention resides in the mechanism for automatically feeding a strip of the cartridges through the tool, and the mechanism for frictionally retaining the piston in position preparatory for firing such mechanism will now be described.

Referring to FIGS. 1, 3, and 4, it will be seen that the breech block has a longitudinal slot 36 with a camming ramp 38. The barrel is provided with a lever 40 fixed to the barrel and aligned with the slot. The lever 40 pivotally carries a camming finger 42 that is spring loaded, by reason of spring 44, into a downwardly projected position as seen in FIGS. 1 and 4. It will be understood that the camming ramp 38 engages the camming finger 42 as the barrel is retracted and cams the finger into alignment with the longitudinal slot 36. The extended end of lever 40 assures the proper relative engagement between the breech block and barrel for firing.

Referring again to FIG. 4, it will be noted that the strip of cartridges 44 is removably and slideably located in a channel member 45 carried by the breech block which defines a passage between the rearward end of the barrel in its forward position and the forward face of the breech block. The strip is provided on each side with lugs 46 (see also FIG. 5). The lugs on the one side are engaged by the camming finger as the barrel is retracted. As the finger is cammed into the slot 36, the finger forces the strip to move upwardly through the channel member to position a loaded cartridge 48 into alignment with the cartridge chamber of the barrel. The lugs 46 on the opposite side of the strip are engaged by a retaining pin 50 carried on a lever 51 that is pivotally connected to the channel member 45. The lever 51 is mounted in such a way that the pin can pivot upward to permit upward passage of the strip but is prevented from pivoting downward to thus prevent downward movement of the strip. Thus, as the barrel is moved forward and out of engagement with the breech block, the camming finger is again biased into its downward position by spring 44, but the strip stays in place by reason of the mentioned engagement of the retaining pin 50 with the lugs on that side of the strip. The retaining pin 50 allows upward movement, and the next retraction of the barrel causes the camming finger to engage the next successive lug to move a new cartridge into position.

The retaining mechanism is most clearly shown in FIGS. 3 and 3*a*. The barrel 14 includes a barrel extension 52 which is screwed into the end of the main barrel portion. This barrel extention is adapted for removal to permit removal of the piston 20 for repair of replacement. A lateral opening 54 provided in the barrel extension permits the entry of a retaining clip 56. This retaining clip is resilient and is formed into a double loop as shown in FIG. 3*a* with the loop openings adapted to receive, when slightly sprung open, the forward end of the piston 20. Although only one of the loops receive the piston, they are identical to permit the clip to be inverted. It will be understood that the gripping action of the clip on the piston prevents free sliding of the piston. Thus when the piston is retracted and in its ready to be fired position, the clip holds the piston in that position until firing.

The loop of the clip 56 not containing the piston 20 resides in the opening 54 and protrudes slightly through the opening and into engagement with the inner wall of the main barrel portion. A longitudinal groove 58 in this inner wall of the main barrel portion permits the clip to expand into the groove to further resist turning of the barrel extension relative to the main barrel portion. Because the loop is resilient, forced turning will compress the clip and thus turning either onto or off of the main barrel portion is premitted. However, during each turn of the barrel extension when the clip is aligned with the broove 58, it tend to "lock." Thus, the clip serves the added function of preventing inadvertent removal and eliminates the need for a set screw.

The features of the invention will be readily understood by those skilled in the art as will it be apparent that a number of modifications can be made without departing from the scope of the invention. Accordingly, the invention is encompassed by the claims appended hereto and not limited to the specific disclosure set forth above.

What is claimed is:

1. A tool for explosively driving elongated fasteners into work surfaces comprising; a housing, a barrel slideable in the housing between a forward and rearward position and being normally biased in its forward position and projected from the housing for engagement with a work surface, a breech block in the housing rearward of the barrel and cooperative with said barrel to form a cartridge receiving chamber, a camming ramp provided in the breech block, and a trigger mechanism including safety means that renders the trigger operable only when the barrel is forced into its rearward position, a finger member extended rearwardly of the barrel that is pivotally movable between first and second positions, and biasing means biasing the finger member into the first position and in said first position adapted to be engaged by the camming ramp to be cammed by the ramp into the second position as the barrel is forced into its rearward position, the breech block having a passage as an extension of its forward face and in cooperation with the rearward end of the barrel with the barrel in its forward position, which passage is adapted to receive a strip of cartridges, and finger member being adapted to engage the strip of cartridges and thereby move successive cartridges carried by the strip into position between the rear end of the barrel and the forward face of the breech block.

2. A tool for explosively driving elongated fasteners as defined in claim 1 wherein the breech block is provided with an elongated slot having the camming ramp provided at the forward entrance of the slot, a lever extended rearwardly of the barrel in line with the slot to engage the slot when the barrel is forced into its rearward position, and the camming finger pivotally attached to the lever to be engaged by the ramp and forced into alignment with the lever and slot.

3. A tool for explosively driving elongated fasteners as defined in claim 1 in combination with a strip containing a plurality of cartridges, a series of lugs provided along the side of the strip spaced relative to the cartridge spacings, said lugs adapted to be engaged by the camming finger to move successive cartridges of the strip into alignment with the cartridge receiving chamber.

4. A tool for explosively driving elongated fasteners as defined in claim 3 including strip return prevention means fastened to the breech block, lugs provided on the cartridge strip adapted to be engaged by the strip return prevention means to permit movement through the passage as urged by the camming finger and preventing return movement when disengaged by the finger.

* * * * *